US005401189A

United States Patent [19]

Sato

[11] Patent Number: 5,401,189

[45] Date of Patent: Mar. 28, 1995

[54] SHIELD CONNECTOR ASSEMBLY

[75] Inventor: Shigeru Sato, Tokyo, Japan

[73] Assignee: Yamaichi Electronics Co., Ltd., Tokyo, Japan

[21] Appl. No.: 159,146

[22] Filed: Nov. 30, 1993

[30] Foreign Application Priority Data

Dec. 1, 1992 [JP] Japan ..... 4-349710

[51] Int. Cl.[6] ..... H01R 13/648

[52] U.S. Cl. ..... 439/607; 439/345

[58] Field of Search ..... 439/92, 95, 108, 345, 439/607, 350, 609, 610

[56] References Cited

U.S. PATENT DOCUMENTS 4,808,125 2/1989 Waters et al. .

5,037,331 8/1991 Goodman et a. ..... 439/607

5,147,220 9/1992 Lybrand ..... 439/607 X 5,288,244 2/1994 Lien ..... 439/607 X

*Primary Examiner*—Khiem Nguyen

*Attorney, Agent, or Firm*—Wenderoth, Lind & Ponack

[57] ABSTRACT

A shield connector assembly comprises an electrically insulative connector body, and an electrically conductive shielding shell fitted onto the electrically insulative connector body. The shield connector assembly further comprises two electrically conductive lock blocks having engagement elements which are to be subjected to connection with mating connectors. The lock blocks are individually attached to opposite ends of the connector body onto which the electrically conductive shielding shell is fitted, thereby surely contacting the electrically conductive lock blocks to the electrically conductive shielding shell.

7 Claims, 8 Drawing Sheets

SHIELD CONNECTOR ASSEMBLY

BACKGROUND OF THE INVENTION

1. Field of the Invention

This invention relates to a shield connector assembly comprising an electrically insulative connector body and an electrically conductive shielding shell.

2. Description of the Prior Art

In a conventional shield connector assembly of this type as represented by U.S. Pat. No. 4,808,125, an electrically conductive shielding shell of a hollow type is fitted onto an electrically insulative connector body in such a manner as to enclose the outer periphery of the connector body, and an electrically conductive framework is formed of a zinc die-cast or aluminum die-cast product such that the three component parts are integrally formed. Engagement elements are formed on protrusion portions at opposite ends of the electrically conductive framework in such a manner as to be erect upwardly therefrom, so that the engagement elements may be subjected to connection with mating connectors. Mounting holes are formed in the protrusion portions and the shield connector is mounted on a wiring board through the mounting holes.

However, since the electrically conductive framework, which is formed of an aluminum die-cast product or zinc die-cast product, is large in size and heavy in weight, the whole shell connector is increased in weight. Moreover, the elongated frame elements constituting the framework are frequently warped.

This warp occurs particularly frequently when, for example, the framework is being plated. Warped frameworks are difficult to engage with an electrically insulative connector body. Therefore, such warped frameworks are discarded as inferior products. This causes a poor yield of product and eventually results in high-cost. This warp problem of the framework becomes more significant as the number of contacts is increased and the connector body and framework are made narrower.

Furthermore, since the connector assembly is of a framework structure, the shell, which can be inserted therein, is physically limited to one kind. This means that every time the number of contacts is different, a different framework is necessary to prepare. This is uneconomical, indeed.

SUMMARY OF THE INVENTION

It is therefore a general object of the invention to provide a shield connector assembly which is capable of fundamentally solving the above-mentioned problems inherent in the prior art.

To achieve the above object, there is essentially provided a shield connector assembly comprising an electrically insulative connector body, and an electrically conductive shielding shell fitted onto the electrically insulative connector body, wherein the shield connector assembly further comprises two electrically conductive lock blocks having engagement elements which are to be subjected to connection with mating connectors, the lock blocks being individually attached to opposite ends of the connector body onto which the electrically conductive shielding shell is fitted, thereby surely contacting the electrically conductive lock blocks to the electrically conductive shielding shell.

As described above, according to the present invention, the electrically conductive framework formed of a die-cast product as in the prior art is eliminated, and a pair of lock blocks are juxtaposed to opposite ends of the electrically insulative connector onto which the electrically conductive shell is fitted. Accordingly, the warping problem associated with the use of the electrically conductive framework is obviated. As a result, the yield of inferior products is improved, thereby achieving a cost reduction.

Furthermore, since the individual lock blocks are juxtaposed to the opposite ends of the connector, they can be used for connectors which are different in length. Since it is unnecessary to prepare a different framework every time connectors having different length are used, the assembly of the present invention is highly economical. Moreover, owing to the employment of the electrically conductive lock blocks, the whole connector can be made light in weight.

DETAILED DESCRIPTION OF THE EMBODIMENT

FIGS. 1 to 6 show a first embodiment of the present invention and FIGS. 7 to 13 show a second embodiment thereof. A structure common to the first and second embodiments will be described first and then a structure specific to each of them will be described.

Figure 1:
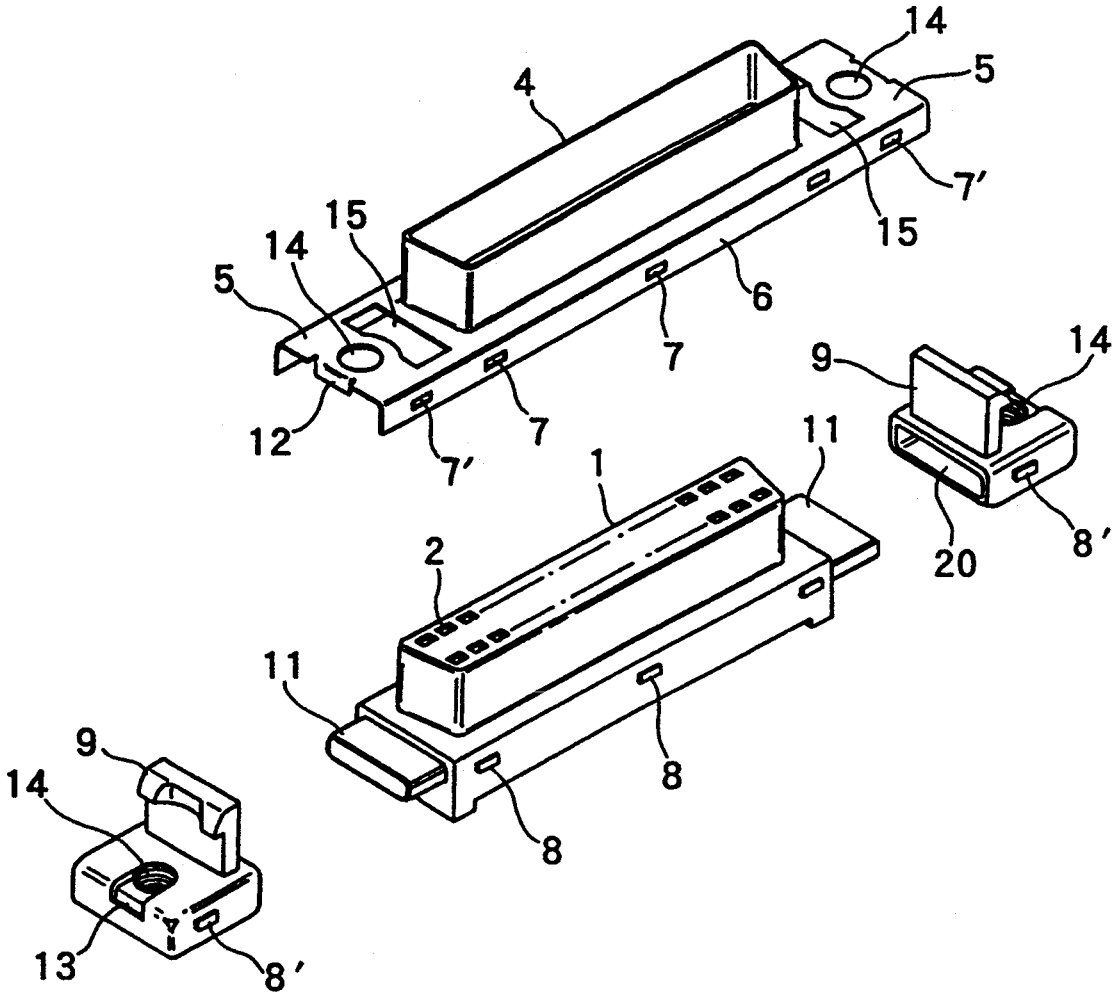
FIG. 1 is an exploded perspective view of a shield connector assembly according to a first embodiment of the present invention.
Figure 2:
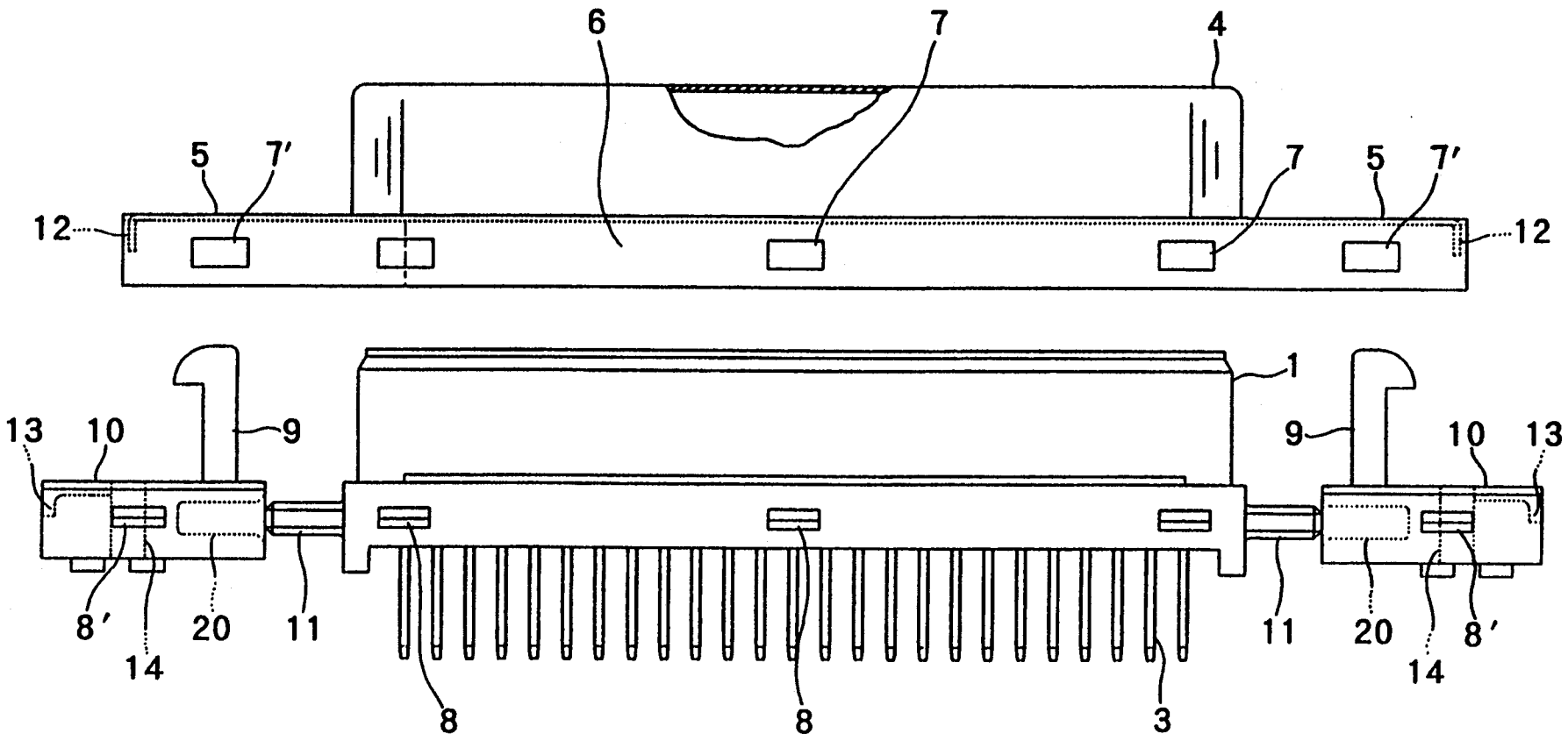
FIG. 2 is an exploded front view of the above assembly.
Figure 3:
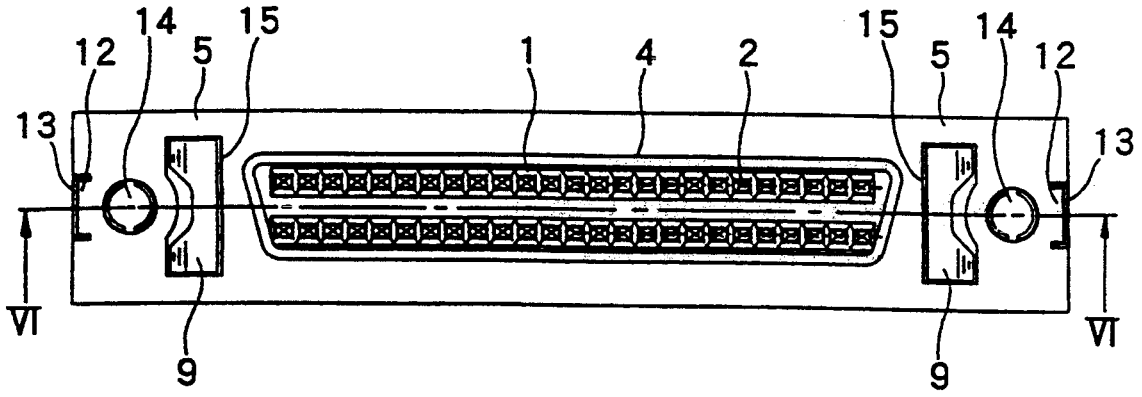
FIG. 3 is a plan view of the above shield connector assembly, but now in an assembled condition.
Figure 4:
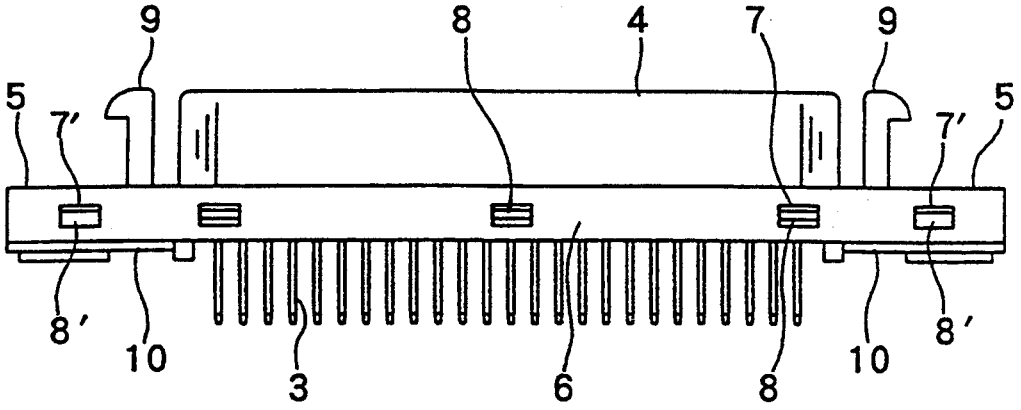
FIG. 4 is a front view thereof.
Figure 5:
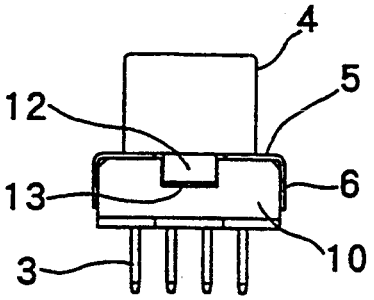
FIG. 5 is a side view thereof.
Figure 6:
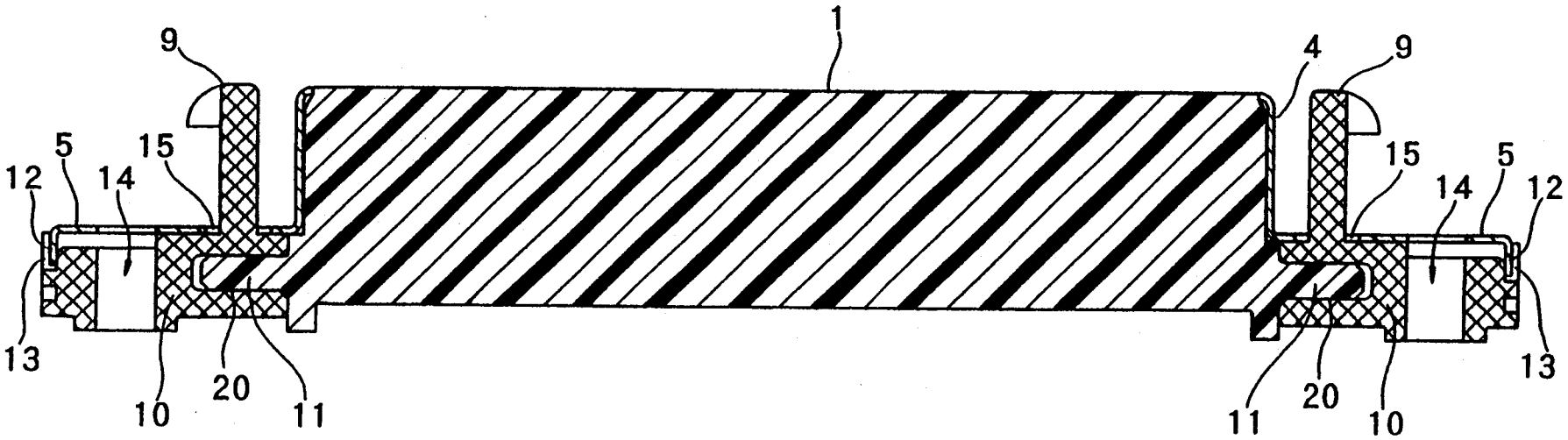
FIG. 6 is a sectional view taken on line VI—VI of FIG. 3.
Figure 7:
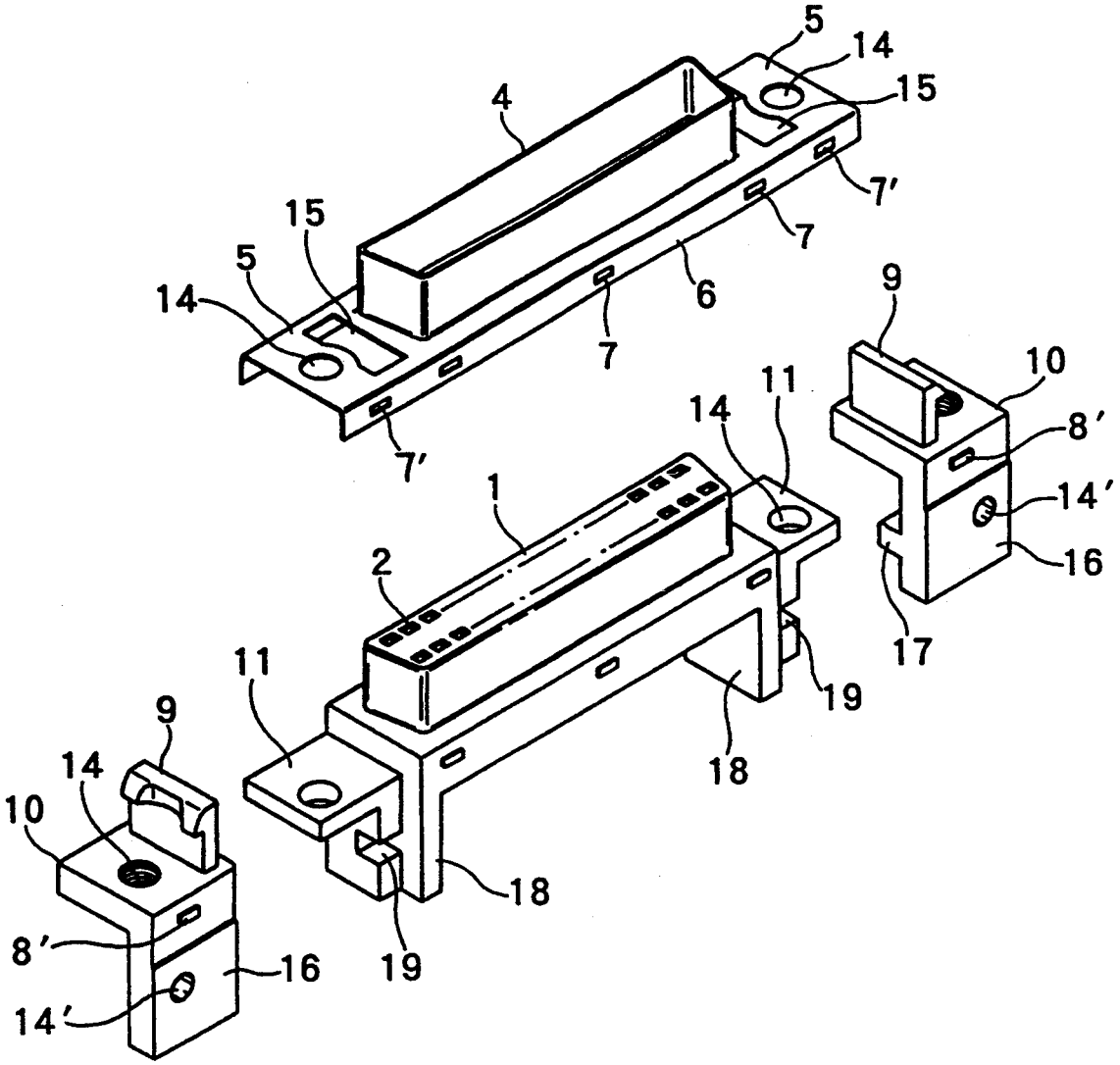
FIG. 7 is an exploded perspective view of a shield connector assembly according to a second embodiment of the present invention.
Figure 8:
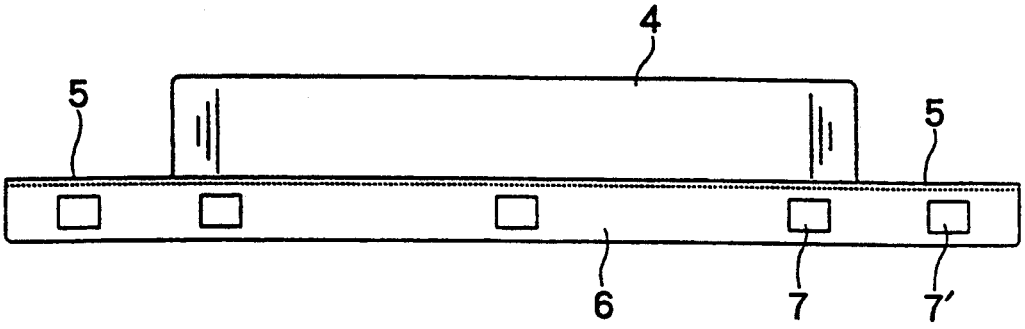
FIG. 8 is a front view of an electrically conductive shell of the above assembly.
Figure 9:
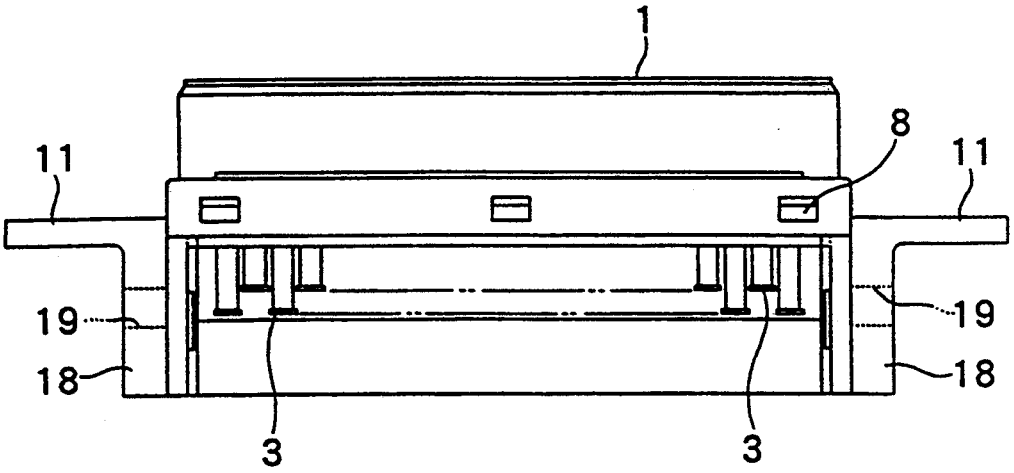
FIG. 9 is a front view of an electrically insulative connector body.
Figure 10:
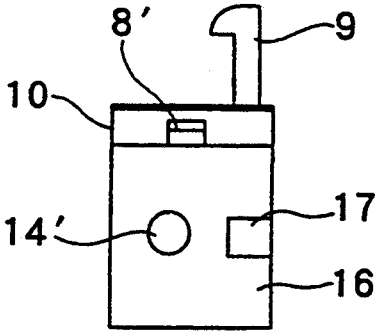
FIG. 10 is a front view of an electrically conductive lock block at one end of the above.
Figure 11:
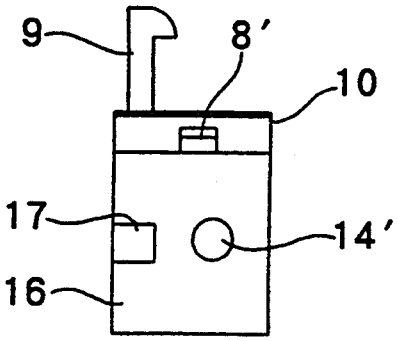
FIG. 11 is a front view of an electrically conductive lock block at the other end of the above.
Figure 12:
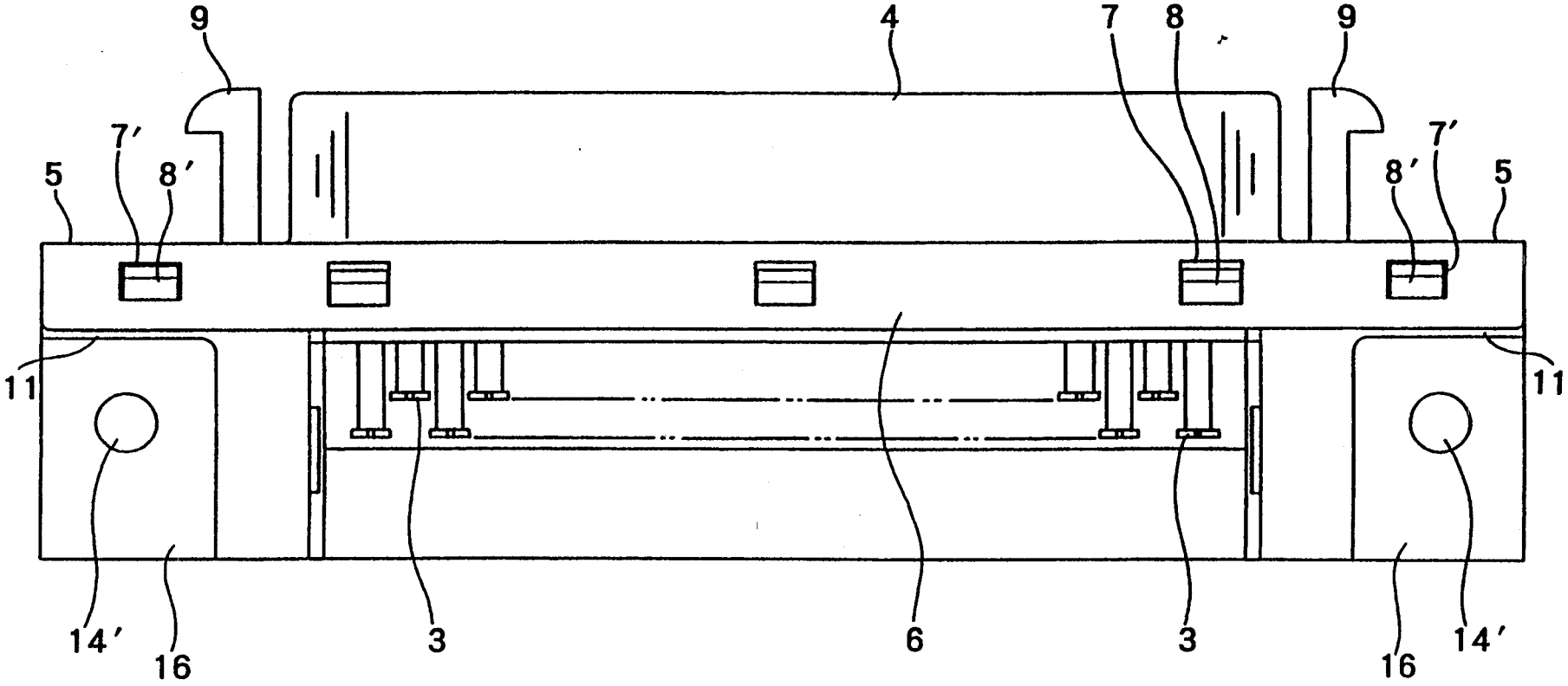
FIG. 12 is a front view of the above shield connector assembly, but now in an assembled condition.
Figure 13:
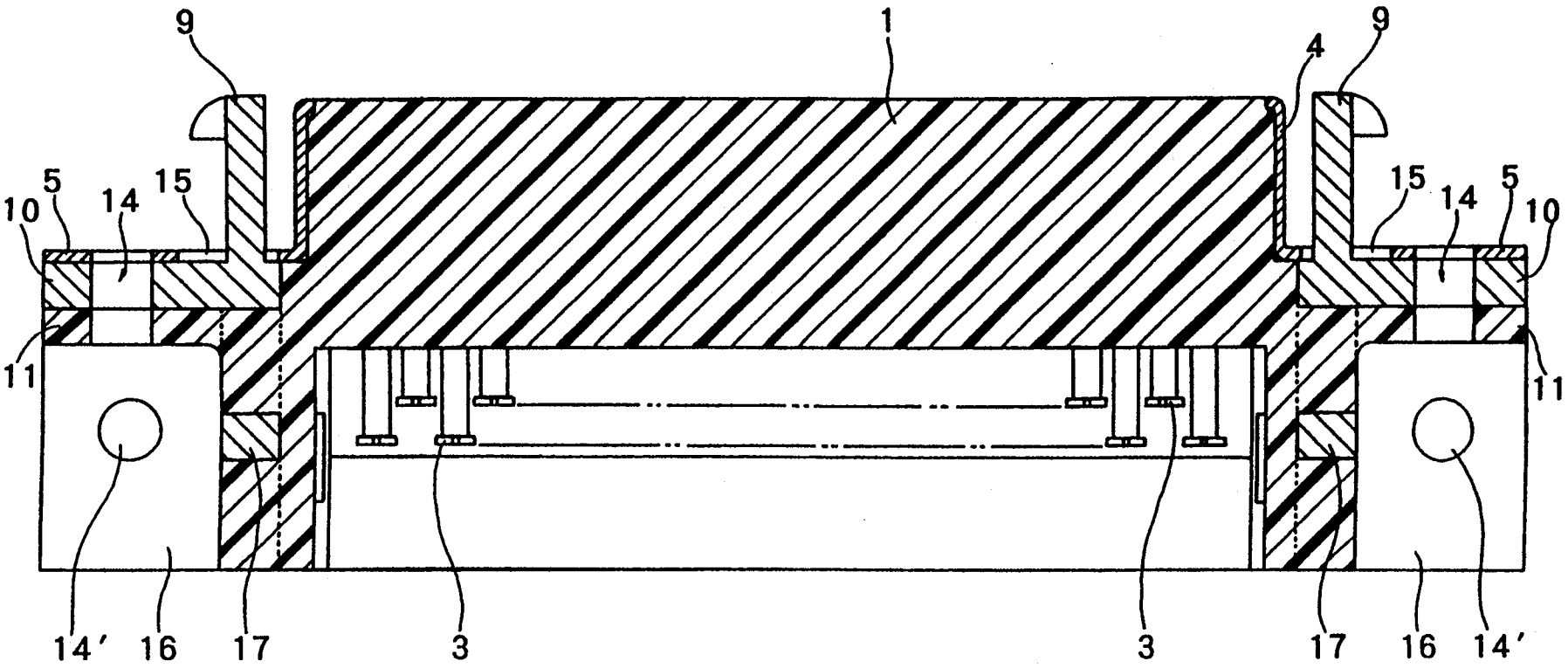
FIG. 13 is a sectional view of the above assembly.

Reference numeral 1 denotes an electrically insulative connector body which is rigidly formed of synthetic resin material. The connector body 1 is provided at an upper surface thereof with a plurality of terminal insertion apertures 2 into which male terminals of corresponding connectors are inserted. Contacts are disposed within the terminal insertion apertures 2 so that the male terminal inserted into the apertures 2 may contact the contacts. Contact elements 3 connected to lower ends of the contacts extend downwardly of the lower surface of the connector body 1. As shown in FIGS. 2 and 4, the contact elements 3 serve as male terminals which are inserted for connection into through-holes formed in a wiring board or as pressure-contacting terminals which are pierced into a flat cable so as to contact lead wires.

Reference numeral 4 denotes an electrically conductive shielding shell. The shell 4 is provided with a hollow having an open top and an open bottom. The shell 4 has seat elements 5 expanding sideward from lower opposite ends thereof generally at the same elevation as the bottom surface of the shell. Flange elements 6, which bending downwardly, are formed along the longitudinal sides and over the entire length of the shell 4 from opposite edge portions of the seat elements 5. In other words, the flange elements 6 extend from opposite edges of the seat element 5 at one end of the shell 4 to opposite edges of the seat element 5 at the other end of the shell 4 lying along the opposite longitudinal sides (i.e., opposite longitudinal edges of the open bottom) of the shell 4.

For assembly, the electrically conductive shielding shell 4 is fitted onto the electrically insulative connector body 1 in such a manner as to enclose the outer surface of the connector body 1, and a plurality of projections 8 projecting outwardly from opposite longitudinal side surfaces of the connector body 1 are brought into engagement with a plurality of engagement holes 7 formed in the flange elements 6. The electrically conductive shell 4 is integrally formed by drawing a metal plate.

Two electrically conductive lock blocks 10, each having an engagement element 9 engageable with a mating connector, are formed. Each lock block 10 is formed of a zinc die-cast or aluminum die-cast product. The lock blocks 10 are integrally juxtaposed to opposite lengthwise ends of the electrically insulative connector body 1 onto which the electrically conductive shell 4 is fitted, thereby realizing a contacting relation between the electrically conductive lock blocks 10 and the electrically conductive shell 4.

In order to realize a contacting relation between the electrically conductive lock blocks 10 and the electrically conductive shielding shell 4, the lock blocks 10 are held between seat elements 11 protruding sideward from opposite ends of the connector body 1 and the seat elements 5 protruded sideward from opposite ends of the electrically conductive shell 4.

The seat elements 5 protruded sideward from the opposite ends of the shell 4 are superimposed on the upper surfaces of the lock blocks 10, and mounting holes 14 are formed in the superimposing portion in such a manner as to extend all the way through the shell 4 and lock blocks 10.

The seat elements 5 protruded sidewardly from the opposite ends of the electrically conductive shielding shell 4 are superimposed on the upper surface of the electrically conductive lock blocks 10 and the engagement elements 9 formed on the lock blocks 10 are inserted into openings 15 formed in the seat elements 5 so as to project upwardly.

A structure for assembling the electrically conductive lock blocks 10 and the electrically conductive shell 4 together will be described with reference to the first embodiment shown in FIGS. 1 through 6.

The seat elements 11 are protruded sidewardly from the opposite ends of the electrically insulative connector body 1. Seat element insertion portions 20 are formed in one side surface of each of the respective electrically conductive lock blocks 10 and the seat elements 11 are inserted into the seat element insertion portions 20. At this time, by forcing the seat elements 11 into the seat element insertion portions 20, the connector body 1 and the lock blocks 10 can be united together. That is, this invention includes a case where projection portions provided on the opposite ends of the electrically insulative connector body 1 are press-fitted into the lock blocks 10, in other words, the connector body 1 and the lock blocks 10 are formed into an integral structure through a press-fit structure.

The seat elements 5 protruded from the opposite ends of the electrically conductive shell 4 are superimposed on the upper surface of the electrically conductive lock blocks 10. The flange elements 6 bent from the edge portions of the seat elements 5 are provided with engagement holes 7', and projections 8' projecting from the side surfaces of the lock blocks 10 are brought into engagement with the engagement holes 7' so that the electrically conductive lock blocks 10 may be joined with the seat elements 11.

Engagement claws 12 formed on end portions of the seat elements 5 are inserted into recesses 13 formed in end faces of the electrically conductive lock blocks 10 in order to prohibit sideward escape.

By doing this, the electrically conductive lock blocks 10 are held between the seat elements 5 protruded from the opposite ends of the electrically conductive shell 4 and the seat elements 11 protruded from the opposite ends of the electrically insulative connector body 1, thereby ensuring a reliable contact with the electrically conductive shell 4.

The engagement elements 9 engageable with the mating connectors are erected upwardly from the upper surfaces of the electrically conductive lock blocks 10. The engagement elements 9 are inserted into the openings 15 formed in the seat elements 5 so as to project upwardly of the seat elements so that the engagement elements 9 may be subjected to connection with the mating connectors.

The seat elements 5 projecting from the opposite ends of the electrically conductive shielding shell 4 are superimposed on the upper surfaces of the electrically conductive lock blocks 10. The mounting holes 14 are formed all the way through the superimposing portions of the seat elements 5 and the lock blocks 10. Lock pins, screws or the like are inserted into the mounting holes 14 and then inserted for connection into through-holes formed in a wiring board.

Next, a structure for assembling the electrically conductive lock blocks 10 and the electrically conductive shell 4 together will be described with reference to the second embodiment shown in FIGS. 7 to 13.

The seat elements 11 are protruded sidewardly from the opposite ends of the electrically insulative connector body 1. The electrically conductive lock blocks 10 are placed on the upper surfaces of the seat elements 11, and the seat elements 5 protruded from the opposite ends of the electrically conductive shell 4 are placed on the upper surfaces of the blocks 10. The electrically conductive lock blocks 10 are held between the seat elements 5 and 11. The projection 8' formed on the side surfaces of the lock blocks 10 are brought into engagement with the engagement holes 7' formed in the flange elements 6 so that the connector body 1, the shell 4 and the lock blocks 10 may be formed into an integral structure.

The mounting holes 14 are formed all the way through the seat elements 5 and 11 and the electrically conductive lock blocks 10. Lock pins, screws or the like are inserted into the mounting holes 14 and these lock pins, or the like are inserted for connection into through-holes formed in the wiring board. The engagement elements 9 are inserted into the openings 15 formed in the seat elements 5 from the upper surfaces of the lock blocks 10 so as to project upwardly of the seat elements so that the engagement elements 9 may be subjected to connection with the mating connectors.

Seat elements 16 are integrally formed with the lock blocks 10 in such a manner as to extend downwardly from the side edge portions of those portions of the lock blocks 10 on which the seat elements 5 are superimposed. Mounting holes 14' are formed in the seat elements 16. Lock pins, screws or the like are inserted into the mounting holes 14', and the lock pins or the like are inserted for connection by soldering into through-holes formed in the wiring board. That is, for the foregoing connection, the shield connector is placed in a horizontal posture and the seat elements 16 are superimposed on the surface of the wiring board.

Projection elements 17 are formed on the seat elements 16 in such a manner as to project inwardly from inner edge portions of the seat elements 16. On the other hand, engagement grooves 19 are formed in side walls 18 extending downwardly from basal portions of the seat elements 11 of the connector body 1. The inner edge portions of the seat elements 16 are brought into abutment with the side surfaces of the side walls 18, and the projection elements 17 are brought into engagement with the engagement grooves 19 for correct positioning.

According to the present invention, there can be eliminated the problem of warping inherent in the prior art where an electrically conductive framework formed of a die-cast product, and a cost reduction can be achieved by improving generation of inferior products due to warping.

Since a pair of lock blocks are individually juxtaposed to the opposite ends of the connector, they can be used for connectors which are different in length. Therefore, it is not necessary to use a framework for each type of connector as in the prior art, and is thus very economical.

Accordingly, a plurality of products can easily be produced by reducing the molding die. Also, the electrically conductive lock blocks enables one to make the whole connector light in weight.

What is claimed is:

1. A shield connector assembly comprising:

an electrically insulative connector body, said connector body having opposite ends and projection portions formed on said opposite ends;

an electrically conductive shielding shell fitted onto said connector body; and two electrically conductive lock blocks having mating connector engagement elements, said lock blocks being individually attached to said opposite ends of said connector body such that said lock blocks contact said electrically conductive shielding shell by said projection portions being internally press-fitted into said electrically conductive lock blocks.

2. The shield connector assembly of claim 1, wherein said electrically conductive shielding shell has opposite ends and seat elements protruding from said opposite ends superimposed over respective upper surfaces of said lock blocks, and wherein mounting holes extend through said seat elements and said lock blocks where said seat elements and said lock blocks are superimposed.

3. The shield connector assembly of claim 1, wherein said electrically conductive shielding shell has opposite ends and seat elements protruding from said opposite ends superimposed over respective upper surfaces of said lock blocks, said seat elements having openings formed therein through which said mating connector engagement elements project.

4. A shield connector assembly comprising:

an electrically insulative connector body, said connector body having opposite ends and first seat elements protruding from said opposite ends;

an electrically conductive shielding shell fitted onto said connector body, said electrically conductive shielding shell having opposite ends and second seat elements protruding from said opposite ends; and two electrically conductive lock blocks having mating connector engagement elements, said lock blocks being individually attached to said opposite ends of said connector body such that said lock blocks contact said electrically conductive shielding shell by said lock blocks being held between said first and second seat elements.

5. The shield connector assembly of claim 4, wherein said first seat elements are superimposed over respective upper surfaces of said lock blocks, and wherein mounting holes extend through said first seat elements and said lock blocks where said first seat elements and said lock blocks are superimposed.

6. The shield connector assembly of claim 4, wherein said first seat elements are superimposed over respective upper surfaces of said lock blocks, and wherein mounting holes extend through over respective upper surfaces of said lock blocks, said first seat elements having openings formed therein through which said mating connector engagement elements project.

7. The shield connector assembly of claim 4, and further comprising third seat elements on said lock blocks extending perpendicularly from respective portions of said lock blocks held between said first and second seat elements, each of said third seat elements having a mounting hole therethrough.

* * * * *